United States Patent [19]

Cheiten

[11] 3,962,731

[45] June 15, 1976

[54] FLAPPER-TYPE DISCHARGE VALVE FOR FLUSH TANKS

[75] Inventor: Samuel S. Cheiten, Highland Park, N.J.

[73] Assignee: Marvin H. Cheiten, Princeton, N.J.

[22] Filed: July 10, 1975

[21] Appl. No.: 594,639

Related U.S. Application Data

[63] Continuation-in-part of Ser. No. 457,659, April 3, 1974, abandoned, which is a continuation-in-part of Ser. No. 349,808, April 10, 1973, abandoned, which is a continuation-in-part of Ser. No. 201,727, Nov. 24, 1971, abandoned.

[52] U.S. Cl. ..... 4/56; 4/57 P

[51] Int. Cl.[2] ..... E03D 1/34

[58] Field of Search ..... 4/56, 57 P, 52, 57, 4/62

[56] References Cited

UNITED STATES PATENTS

| | | | |
|---|---|---|---|
| 1,947,627 | 2/1934 | Wayne | 4/56 |
| 2,117,629 | 5/1938 | Rosenthal | 4/56 |
| 2,589,110 | 3/1952 | Meltsner | 4/56 |
| 2,607,924 | 8/1952 | Kurkjian | 4/56 X |
| 2,705,808 | 4/1955 | Crockett | 4/56 |
| 2,834,027 | 5/1958 | Coffelt | 4/56 |
| 2,876,458 | 3/1959 | Schmidt et al. | 4/57 P |
| 3,060,451 | 10/1962 | Schulhoff, Jr. | 4/56 |
| 3,121,234 | 2/1964 | Micek | 4/56 |
| 3,239,848 | 3/1966 | Zrolka | 4/57 P |
| 3,707,733 | 4/1971 | Gore et al. | 4/56 |

*Primary Examiner*—Henry K. Artis
*Attorney, Agent, or Firm*—Robert A. Green

[57] ABSTRACT

A flapper discharge valve comprises a movable flapper which is adapted to be movably seated on the opening in the outlet pipe by way of which the toilet tank empties. The flapper is adapted to be pivoted into or out of operative relation with this opening, whereby it either covers the opening to prevent water from escaping therethrough or it uncovers the opening to permit water to escape therethrough. The flapper carries a projecting member on its top surface which provides a streamlining action which assists the flapper in pivoting in the water and freeing the outlet opening so that water can escape, and it also includes various other projecting portions, including one on its bottom surface, which assist the flapper in performing its opening and closing operations. The projecting members on the top and bottom surfaces serve, among other things, to impart buoyancy to the flapper valve, and the provision of the projecting member on the top surface makes it possible to minimize the size of the projecting member on the bottom surface, thus eliminating or substantially lessening the likelihood of said member catching or snagging on the lip of the outlet opening and so failing to cover this opening.

24 Claims, 12 Drawing Figures

INVENTOR.

BY

Fig. 2
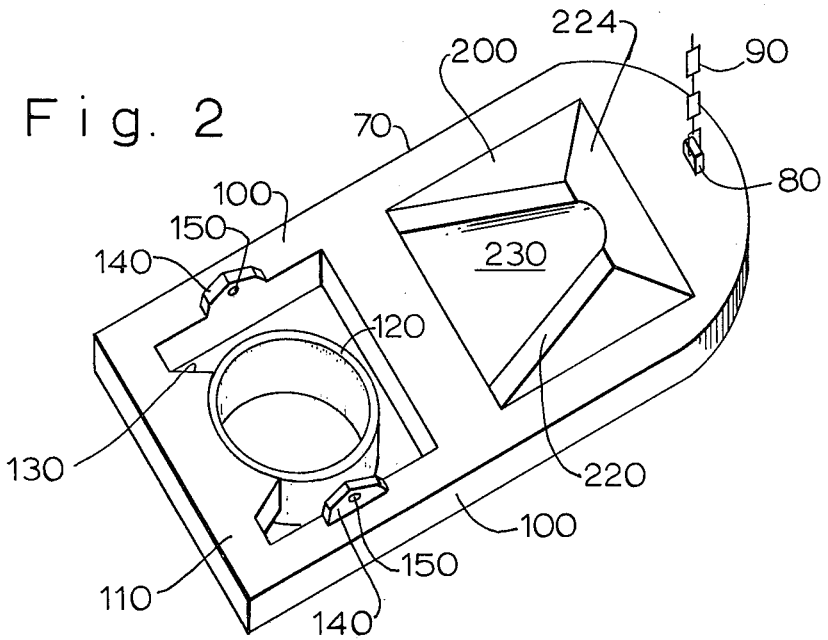
Fig. 3
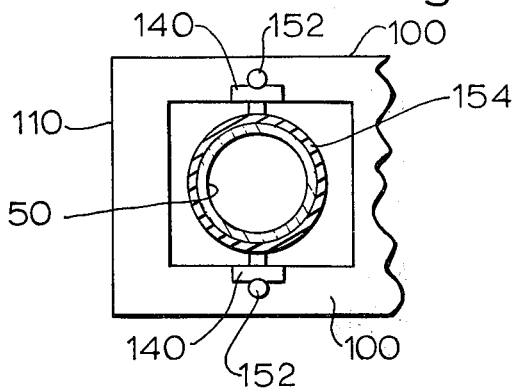
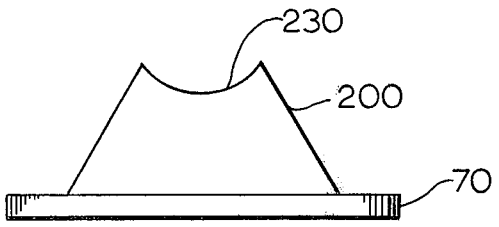
Fig. 4
INVENTOR.
BY

INVENTOR.

BY

Fig. 11
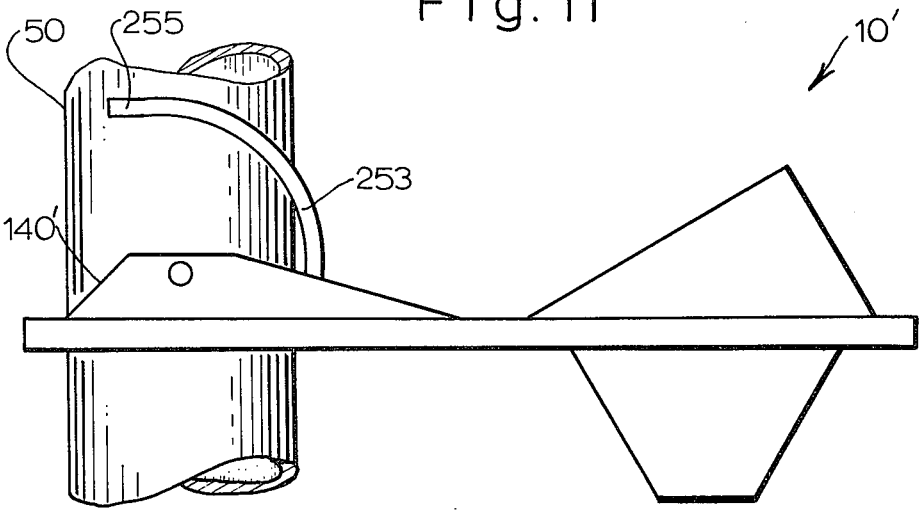
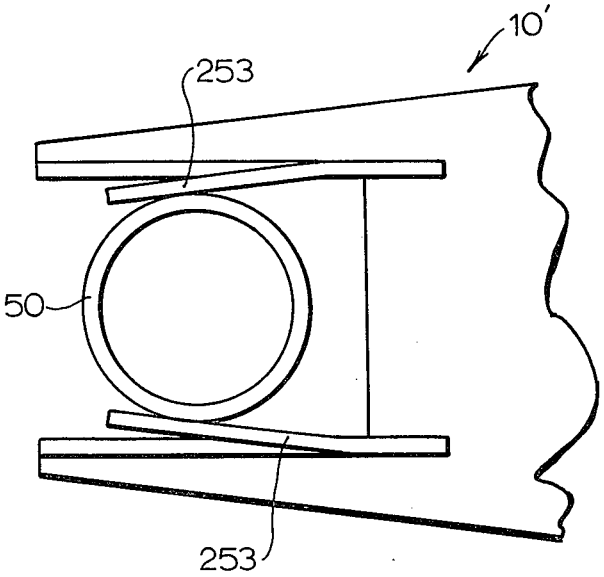
Fig. 12

FLAPPER-TYPE DISCHARGE VALVE FOR FLUSH TANKS

This application is a continuation-in-part of application Ser. No. 457,659, filed Apr. 3, 1974, as a continuation-in-part of application Ser. No. 349,808, filed Apr. 10, 1973, now abandoned, as a continuation-in-part of application Ser. No. 201,727, filed Nov. 24, 1971, and now abandoned.

BACKGROUND OF THE INVENTION

Flapper valves have been used in toilet flush tanks for some time, and all are substantially of the same construction. Such valves comprise a relatively large-area rubber member which is pivotally secured to the overflow pipe, and is pivoted by means of the usual hand-operated lever mechanism into and out of operative relation with the outlet pipe from the toilet tank. The flapper valve carries a depending ball-like member, by means of which it seats in the opening in the outlet pipe when it is in the closed position.

The ball-like member also provides a buoyancy or lift which assists the valve in raising off the outlet pipe when it is desired to have water flow out of the tank. The operation appears to be as follows. The operator manipulates the lever mechanism to move the flapper off the outlet pipe. As the flapper begins to rise and as water beings to flow out of the outlet pipe, it provides a lifting force on the ball member to raise the valve completely off the outlet pipe and to thus permit the tank to empty as required.

For proper operation and to impart suitable buoyancy and lift, the ball is made hollow and of relatively large volume. In fact, as compared to the diameter of the outlet pipe, the ball is so large that it can easily, and often does, hang up on the outlet pipe and the desired seal is not made with the outlet pipe when the valve is in the closed position. This problem is magnified when the ball ages and swells after being in water for a considerable length of time. In addition, the general efficiency of the operation of flapper valves can always be improved, and the present invention is directed toward providing such improvement.

SUMMARY OF THE INVENTION

Briefly, a flush valve embodying the invention comprises a flapper member which controls the state of the opening in the outlet pipe of a flush tank. The flapper carries auxiliary structural members which assist its opening and closing actions.

DESCRIPTION OF THE DRAWINGS

FIG. 2 is a perspective view of the flush valve of the invention;

FIG. 3 is a plan view of a portion of the flush valve of the invention illustrating one mode of using same;

FIG. 4 is a side elevational view of a portion of a flush valve embodying the invention showing a modification therein;

FIG. 11 is a side elevational view of a portion of a flapper embodying a modification of the invention; and FIG. 12 is a plan view of the flapper of FIG. 11.

DESCRIPTION OF THE PREFERRED EMBODIMENTS

Figure 1:
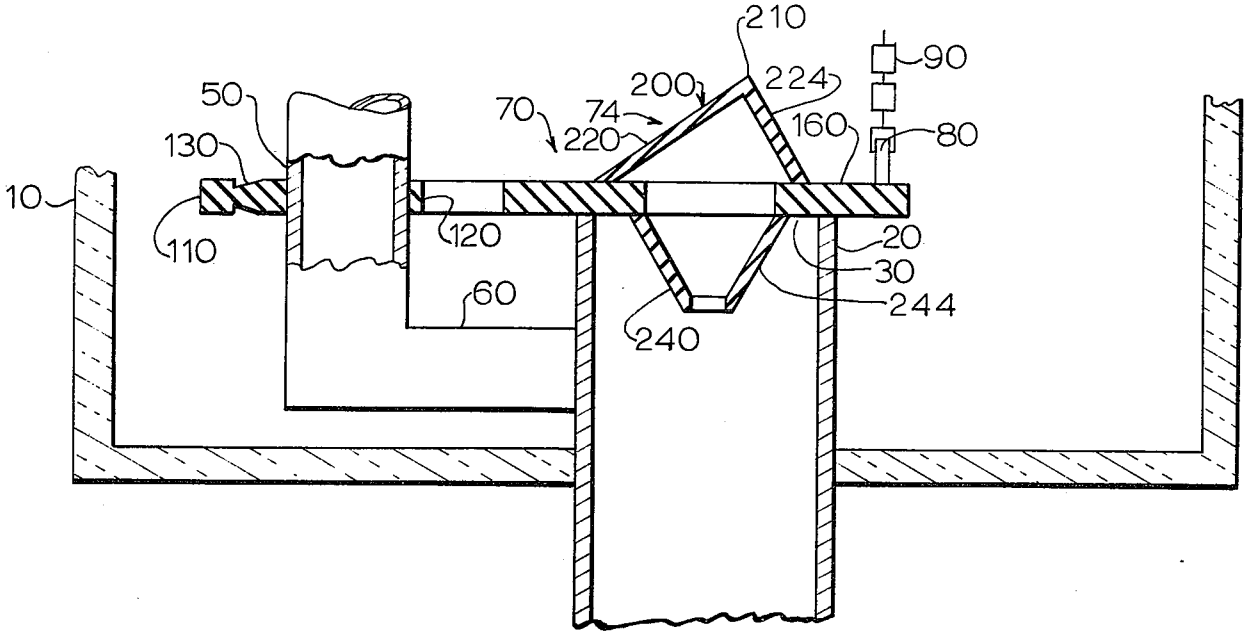
FIG. 1 is a sectional elevational view of a portion of a toilet tank and its operating apparatus and a flush valve embodying the invention.

In FIG. 1, a conventional toilet flush tank is illustrated in section at 10 containing the usual outlet pipe 20 seated in the base of the tank and having an upper open end 30 through which the tank is emptied. An overflow pipe 50 rises from an elbow 60 which extends from pipe 20, and pipe 20 extends through the bottom of the tank and connects into the usual waste plumbing line.

A flapper valve 70 is provided for opening and closing the outlet opening 30 in outlet pipe 20. The flapper is a relatively large flat piece of rubber which is secured to the overflow pipe and lies flat and, in its closed position, overlays opening 30 in pipe 20, as seen in FIG. 1. The flapper is pivotally secured to the overflow pipe, and it is adapted to be pivoted about the pipe as pivot point to be raised off the pipe 20 to permit water in the tank to flow out of the tank through pipe 20.

The flapper includes a large-area portion 74 which generally overlays the opening in outlet pipe 20 and includes on its top surface, at the leading end thereof, a ring or apertured tab 80 to which a chain 90 is secured and from which the chain extends to the usual hand-operated lever (not shown) which comprises part of the usual flushing mechanism for the tank. A pair of arms 100 extend rearwardly to a cross member 110, and a ring 120 is positioned between the cross member 110 and the large-area portion 74 of the flapper. The ring 120 is secured to the cross member 110 by a thin severable web 130, and the ring 120 is adapted to be slipped over the overflow pipe 50 to secure the flapper valve in place in operative relation with the open end of the outlet pipe.

The top surface of each of the arms 100 is provided with an upstanding tab 140 which is provided with an aperture 150. The tabs 140 and their apertures 150 are axially aligned, and, in some toilet arrangements (FIG. 3) in which the overflow pipe carries a ring having hook-like projections 152, for example, as part of a separate mounting collar 154, the ring 120 on the flapper can be removed by cutting web 130, and the flapper is secured to the hooks 152 by means of the apertured ears 140. In this mode of using the flapper of the invention, the cross member 110 holds the arms 100 and the ears 140 carried thereby at the proper spacing so that they do not come loose from hooks 152 on overflow pipe 50. Without cross member 110, arms 100 often come loose from hooks 152, as occurs frequently with prior art flapper valves.

According to the invention, the top surface 160 of the main body portion 74 of the flapper near the front end thereof generally aligned with an overlaying opening 30 in pipe 20, is provided with an upwardly projecting portion 200 (FIGS. 1 and 2) which may be conical, frusto-conical, pyramidal, frusto-pyramidal, or the like. The preferred configuration is generally pyramidal with the pyramid tapered toward the front end of the flapper to provide a surface 220 larger than surface 224. It is noted that portion 200 has a generally line-like or sharply pointed leading edge 210 to provide streamline flow through water. Normally, portion 200 is molded integrally with flapper 70.

In operation, when the flapper 70 is raised by the lifting of chain 90, the sharp leading edge or apex 210 of the projecting portion 200 cuts through the water with a streamlining action and makes it easier for the operator to raise the flapper against the pressure of the water which is bearing down on it. This also speeds the upward movement of the flapper off the outlet pipe and thus permits faster emptying of the water from the tank, and faster emptying of the tank results in a more efficient flushing action by creating a strong flushing suction.

As illustrated in FIG. 2, the projecting portion 200 is preferably oriented so that surface 220 faces the overflow pipe 50 squarely, and this surface is provided with a concave depression 230 which extends along its length from apex to base. The concave depression is positioned and dimensioned so that it bears against the overflow pipe when the flapper is raised, and this insures that the flapper is properly aligned for its return trip back into position covering the opening in the stationary base portion. More specifically, if the flapper is raised and the flow of water moves it out of its proper alignment, as projecting member 200 strikes the outlet pipe, the flapper will move or slip along the overflow pipe due to its wet slipperiness until the depression engages the pipe and the desired orientation is achieved.

In an alternative arrangement shown in FIG. 4, the concave depression 230 is formed only in the apex of the member 200 and does not extend along the entire surface 220.

Figure 5:
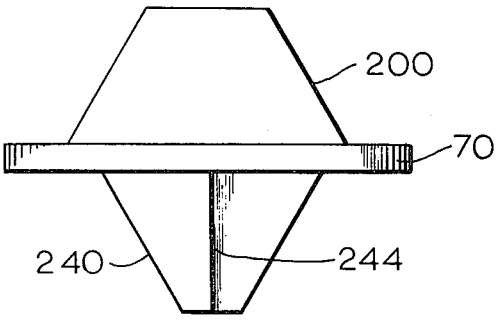
FIG. 5 is a front elevational view of a flush valve embodying the invention.

In addition, as shown in FIG. 1, the bottom surface of the flapper 70 is also provided with a downwardly projecting member 240 which is frusto-conical or frusto-pyramidal and serves to guide the flapper 70 back to its closed position by entering the opening in the outlet pipe 20. The member 240 is preferably generally frusto-pyramidal and is oriented so that a sharp edge 244 faces the forward, leading end of the flapper (FIG. 5). For proper operation, the lower free end of member 240 is open and member 240 is hollow as is member 200, and both member 200 and member 240 form a single hollow chamber. The advantage of member 249 and its orientation is that, when the flapper 70 is raised and released to fall back into position, the leading sharp edge 244 and the other sharp edges thereof bear against the wall of the opening of outlet pipe 20 if the flapper is out of alignment in any direction, and thus this contact forces the flapper into proper alignment as it falls back into position covering the opening in the outlet pipe. With only a sharp edge and not a large-surface ball-like member available to contact the wall of the outlet pipe, as in the prior art, hang-up is unlikely to occur.

However, since the member 200 and the member 240 together provide the hollow chamber which imparts buoyancy and lift to the valve 70 and since the member 200 comprises a relatively large volume, then the volume of member 240 can be relatively small, certainly smaller than the volume of the usual ball member in the prior art. Thus, since member 240 is relatively small, the likelihood of its contacting and hanging up on the wall of the outlet pipe is remote.

To summarize this aspect of the invention, if the flapper valve is moved extensively out of its normal alignment, then the member 240 will guide it back into position, and only a sharp edge of this member is likely to contact the outlet pipe. Thus, hang-up is unlikely. However, since the member 240 is relatively small, in case of a relatively minor misalignment of the flapper valve, the member 240 will not contact the outlet pipe and, again, hang-up will not occur.

Figure 6:
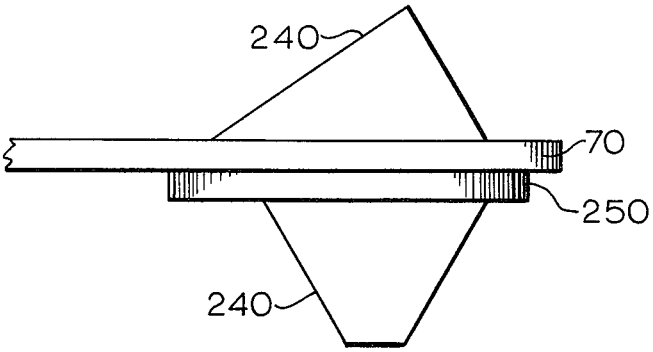
FIG. 6 is a side elevational view of a modification of the invention.
Figure 7:
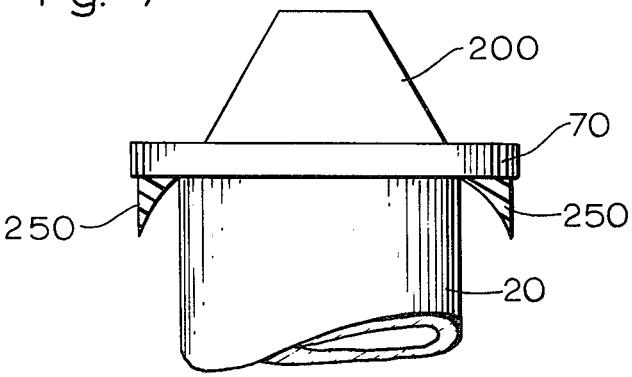
FIG. 7 is a front elevational view of the valve of FIG. 6 illustrating its use.

In a modification of the invention (FIGS. 6 and 7), the bottom surface of the flapper 70 is provided with a pair of generally elongated guide members 250 which are generally triangular in cross-section and extend along portions of the opposed side edges of the flapper 70. These guide members are positioned so that they lie outside of and closely adjacent to, or in contact with, the outer wall of the open end of outlet pipe 20 to assist the flapper 70 to seat properly when it returns to its position overlaying outlet pipe 20. The guide members 250 may also be extended and joined to form a continuous circular guide ring on the lower surface of flapper 70. This is illustrated by the dash lines in FIG. 7.

It has been found that, although wall 110 performs a useful function, under some circumstances, it is desirable to remove it and ring 120 to leave arms 100 free to be secured to the tank overflow pipe, as illustrated in FIG. 3. Arms 100 are normally made thin and quite flexible, and due to the rush of water in the tank and, particularly after some aging, the arms 100 are easily disengaged from hooks 152. Of course, this interferes with normal operation of the flapper valve.

Figure 8:
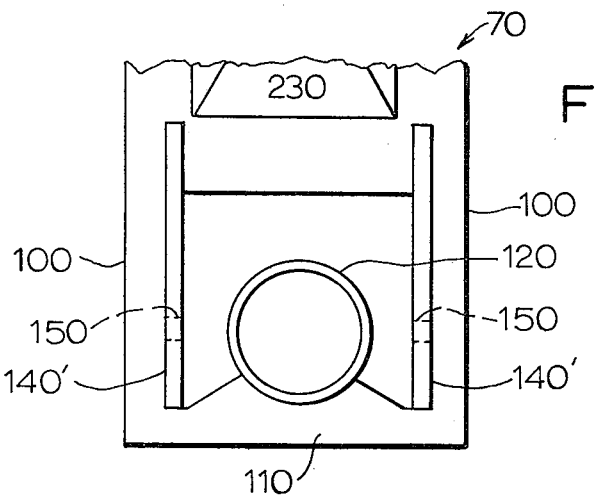
FIG. 8 is a plan view of a portion of a flapper valve illustrating a modification of the invention.
Figure 9:
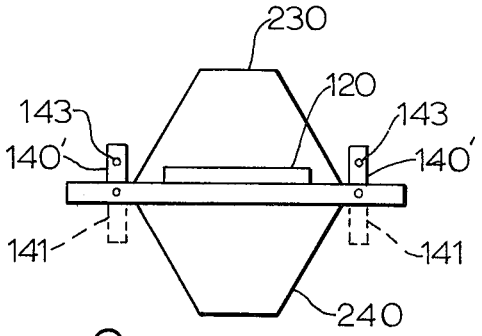
FIG. 9 is a rear, elevational view of the apparatus shown in FIG. 8.
Figure 10:
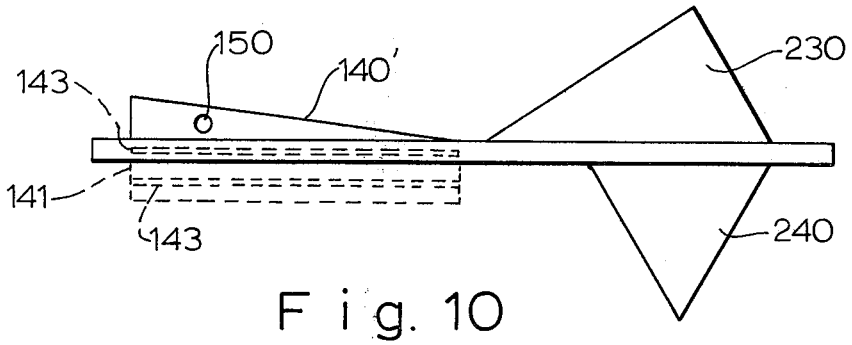
FIG. 10 is a side elevational view of a flapper valve showing the various modifications of the invention.

Thus, in a modification of the invention illustrated in FIGS. 8 to 10, means are provided for rendering the arms 100 more rigid without interfering with their desired normal functioning. In one arrangement for achieving this effect, apertured tabs or ribs 140' are provided which extend along arms 100, from their usual location on arms 100 to permit attachment to hooks 152, forwardly along the arms to the large body portion 70 of the flapper. Thus, the tabs or ribs 140' join and become part of the large front body portion 70 of the flapper valve and act as reinforcing ribs. The attachment of ribs 140' to the relatively strong and rigid portion 70 imparts sufficient rigidity to the arms 100 so that they tend not to be easily removed from hooks 152. However, this does not interfere with the normal function of arms 100. Each combination of an arm 100 and rib 140' has the appearance of an "angle iron".

In a modification of the invention, thin reinforcing ribs 141 similar to ribs 140' may also be provided on the lower surface of arms 100, as shown in FIGS. 9 and 10. Such ribs would have substantially the same length as ribs 140' and would merge with the front portion of the flapper valve.

Auxiliary ribs 141 may be used with tabs 140 or with tabs 140'.

If desired, added strengthening may also be attained in arms 100 by providing reinforcing wires 143 in arms 100 or in ribs 140' or in ribs 141, or in all three.

In a modification of the invention illustrated in FIGS. 11 and 12, a flapper 10' is provided with auxiliary means to impart greater stability thereto. This means comprises a relatively rigid guide arm 253 of plastic, rubber, metal, or the like secured to each of the ribs 140' and extending rearwardly and upwardly therefrom and positioned so that the rear end portion 255 of each arm is close to or in contact with the overflow pipe 50.

The arms may be separately fastened to the ribs 140', in any suitable manner, or they may be molded therewith. It can be seen that the side arms 253 prevent excessive lateral movement of the flapper when it opens and reseats and thus assists the flapper in seating and operating properly.

If desired, the guide arms may be secured to other portions of the flapper than tabs 140'.

What is claimed is:

1. A flapper-type control valve for use in controlling the retention and discharge of fluid by streamline action from a tank through an outlet pipe therein, said valve comprising a generally flat, flexible member having securing means at one end, by means of which it can be secured to a vertical pipe adjacent to said outlet pipe which comprises a pivot with respect to which the member rotates when operated to discharge fluid from said tank, said member having a generally flat top surface and a bottom surface and including a large-area portion adapted to overlay and obstruct the outlet opening in said outlet pipe with the fluid in the tank exerting pressure on said top surface thereof, and a projecting member extending upwardly from said top surface of said flat member and having a relatively sharp line-like leading edge for providing generally streamline flow through said water when said valve is raised and rotated to permit said fluid to flow through ssid outlet pipe.

2. The valve defined in claim 1 wherein said projecting member is positioned on said top surface of said member so that it is generally aligned with the opening in said outlet pipe.

3. The valve defined in claim 1 wherein said projecting member is of a wedge-like shape selected from the group of geometric solids including cones, pyramids, frusto-cones, and frusto-pyramids.

4. The valve defined in claim 1 wherein said projecting member is generally pyramidal in shape and includes a surface which is oriented generally facing the vertical pipe to which the valve is secured.

5. The valve defined in claim 4 wherein said surface includes a generally concave depression extending along its length.

6. The valve defined in claim 4 wherein said projecting member includes an apex line having a concave depression therein.

7. The valve defined in claim 1 wherein said projecting member is hollow and includes an opening which communicates with said outlet pipe.

8. The valve defined in claim 1 and including another projecting member which extends downwardly from said bottom surface of said member and is positioned so that it lies within the opening in said outlet pipe when said valve is lying flat over said outlet pipe.

9. The valve defined in claim 8 wherein said other projecting member is generally pyramidal in form.

10. The valve defined in claim 8 wherein said other projecting member is of a shape of a multi-sided member which includes a plurality of sharp edges which can bear against the side wall of said outlet pipe and assist in seating said valve.

11. The valve defined in claim 8 wherein said other projecting member is hollow and communicates with the interior of said projecting member and has an opening in its apex which communicates with its interior.

12. The valve defined in claim 8 and including a pair of generally elongated guide members secured to opposed marginal portions of the bottom surface of said member, outwardly of said other projecting member, and positioned so that they lie adjacent to the outer wall of said outlet pipe when said valve is in position overlaying said outlet pipe.

13. The valve defined in claim 1 and including a pair of arms extending rearwardly from said large-area portion to a cross-piece to which the ends of said arms are connected, an apertured tab on the top surface of each of said arms, and a ring secured to said cross-piece by a severable web and positioned in the space between said cross-piece and said large-area portion, said tabs being positioned on said arms at a location adjacent to said ring.

14. The valve defined in claim 1 wherein said securing means is a pair of arms extending from said large-area portion having an apertured rib on each of said arms for use in coupling said arms to said outlet pipe, each apertured rib extending along substantially the entire length of its arm and including a portion which is coupled to said large-area portion whereby a favorable degree of rigidity is imparted to its arm.

15. The valve defined in claim 14 wherein said arms include upper and lower surfaces and an auxiliary reinforcing rib extends along the lower surface of each of said arms and includes a portion coupled to said large-area portion of said valve.

16. The valve defined in claim 14 and including reinforcing metal pins disposed within said apertured ribs to impart rigidity thereto.

17. The valve defined in claim 1 and including a guide member secured to the lower surface of said flat, flexible member and adjacent to the marginal portion thereof.

18. The valve defined in claim 17 wherein said guide member is annular in form.

19. The valve defined in claim 1 and including a pair of opposed guide members extending from the lower surface of said flat, flexible member adjacent to the margin thereof.

20. The valve defined in claim 8 and including at least one guide member secured to the lower surface of said flexible member outwardly of said other projecting member.

21. A flapper-type control valve for use in controlling the retention and discharge of fluid from a tank through an outlet pipe therein, said valve comprising a generally flexible, large-area portion adapted to overlay and obstruct the outlet opening in said outlet pipe, with the fluid in the tank exerting pressure thereon, a pair of arms extending from said large-area portion, generally parallel to each other for coupling to a vertical pipe adjacent to said outlet pipe with respect to which the valve rotates to lift said large-area portion off said outlet pipe to discharge fluid from said tank, each said arm having an end remote from said large-are portion and an upper surface and a lower surface, and an upstanding apertured rib rising from the top surface of each said arm near the end thereof for use in coupling said arms to said outlet pipe, each apertured rib extending along substantially the entire length of its arm and including a portion which extends to said large-area portion whereby a favorable degree of rigidity is imparted to its arm.

22. The valve defined in claim 21 and including an auxiliary upstanding reinforcing rib which extends along the lower surface of each of said arms and includes a portion which extends to said large-area portion of said valve.

23. The valve defined in claim 21 and including reinforcing metal pins disposed within said apertured ribs and extending along their lengths to impart rigidity thereto.

24. A flapper-type control valve for use in controlling the retention and discharge of fluid from a tank through an outlet pipe therein, said valve comprising a generally flexible, large-area portion adapted to overlay and obstruct the outlet opening in said outlet pipe, with the fluid in the tank exerting pressure thereon, a pair of arms extending from said large-area portion, generally parallel to each other for coupling to a vertical pipe adjacent to said outlet pipe with respect to which the valve rotates to lift said large-area portion off said outlet pipe to discharge fluid from said tank, each said arm having an end remote from said large-area portion and an upper surface and a lower surface, an upstanding apertured rib rising from the top surface of each said arm near the end thereof for use in coupling said arms to said outlet pipe, and a relatively rigid bar secured at one end to each of said apertured ribs and extending rearwardly and upwardly therefrom so that its opposite end is positioned adjacent to said outlet pipe and can provide a guide action with respect to said outlet pipe.

* * * * *